US006315025B1

(12) United States Patent
Mabie

(10) Patent No.: US 6,315,025 B1
(45) Date of Patent: Nov. 13, 2001

(54) REMOVABLE AWNING COVER

(76) Inventor: John J. Mabie, 828 N. Fuller St., Independence, MO (US) 64050

( * ) Notice: Subject to any disclaimer, the term of this patent is extended or adjusted under 35 U.S.C. 154(b) by 0 days.

(21) Appl. No.: 09/625,447

(22) Filed: Jul. 26, 2000

(51) Int. Cl.[7] ..... E04F 10/00
(52) U.S. Cl. ..... 160/22; 160/67
(58) Field of Search ..... 160/22, 23.1, 67, 160/66, 262, 263, 370.22, 238, 71, 80, 250; 135/88.12, 88.11

(56) References Cited

U.S. PATENT DOCUMENTS

| | | | | |
|---|---|---|---|---|
| 1,071,158 | * | 8/1913 | Hurlbut | 160/262 |
| 1,634,303 | * | 7/1927 | Scheller | 160/263 |
| 2,506,285 | * | 5/1950 | Wagner | 160/22 |
| 3,923,074 | | 12/1975 | McKee . | |
| 4,924,895 | | 5/1990 | Bailie . | |
| 5,016,699 | | 5/1991 | Akers . | |
| 5,285,837 | | 2/1994 | Pozzi . | |

* cited by examiner

*Primary Examiner*—David M. Purol
(74) *Attorney, Agent, or Firm*—Henderson & Sturm LLP

(57) ABSTRACT

A removable awning cover in combination with a rolled fabric awning. The awning cover includes a number of overlapping resilient tubular sections with sidewall openings movable between a relaxed width and an expanded width. The awning roll is received through the sidewall opening when expanded and held within the tubular section when relaxed. The top edge of the sidewall opening rests on the awning mounting rail while the bottom edge of the sidewall opening is disposed below the awning roll. The sidewall opening has rounded corners to facilitate installation and removal of the overlapping tubular sections. Each tubular section has one flared end to overlap the next adjacent tubular section and provide ventilation around the awning roll.

8 Claims, 1 Drawing Sheet

REMOVABLE AWNING COVER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of protective covers for awnings, and more particularly to a removable awning cover.

2. Description of Related Art

As can be seen by reference to the following U.S. Pat. Nos. 3,923,074; 4,924,895; 5,016,699 and 5,285,837, the prior art is replete with myriad and diverse protective covers for awnings.

While all of the aforementioned prior art constructions are more than adequate for the basic purpose and function for which they have been specifically designed, they are uniformly deficient with respect to their failure to provide a simple, efficient, and practical removable awning cover.

As a consequence of the foregoing situation, there has existed a longstanding need for a new and improved removable awning cover and the provision of such a construction is a stated objective of the present invention.

BRIEF SUMMARY OF THE INVENTION

Briefly stated, the present invention provides a removable awning cover in combination with a rolled fabric awning. The awning cover includes a number of overlapping resilient tubular sections with sidewall openings movable between a relaxed width and an expanded width. The awning roll is received through the sidewall opening when expanded and held within the tubular section when relaxed. The top edge of the sidewall opening rests on the awning mounting rail while the bottom edge of the sidewall opening is disposed below the awning roll. The sidewall opening has rounded corners to facilitate installation and removal of the overlapping tubular sections. Each tubular section has one flared end to overlap the next adjacent tubular section and provide ventilation around the awning roll.

It is an object of this invention to provide protection from atmospheric elements when the awning is in the retracted position.

It is a further object of this invention to provide an awning cover that is lightweight, removable and requires minimal storage space.

It is another object of this invention to provide an awning cover that is uniquely universal, making it an asset to awning and recreational vehicle manufactures and dealers to prevent atmospheric damage during periods of display to potential buyers.

It is also an object of this invention to provide an awning cover that is low cost, maintenance free, virtually undetectable, and requiring no tools or professional assistance in installation.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
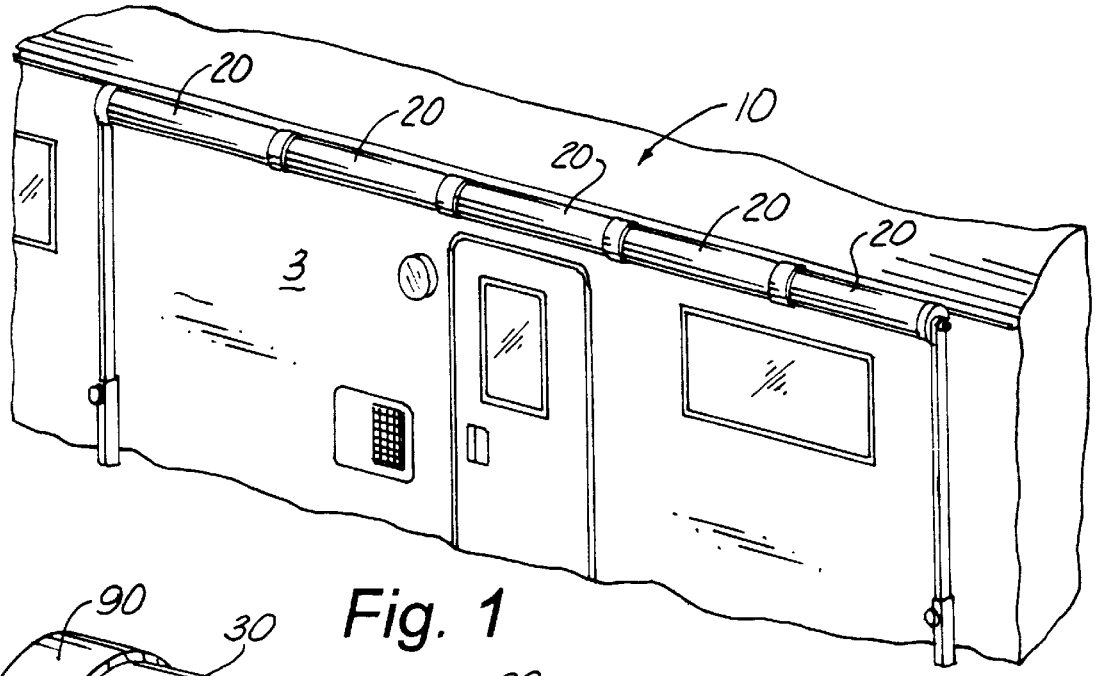
FIG. 1 is a perspective view showing the awning cover of the present invention covering a retracted awning on a recreational vehicle.
Figure 3:
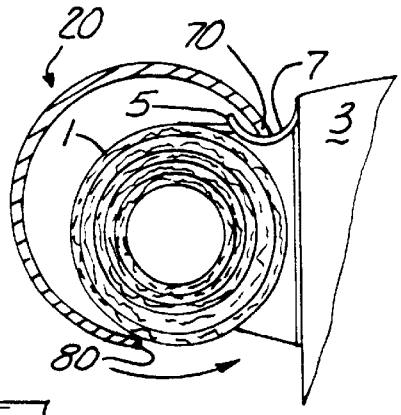
FIG. 3 is an end elevation sectional view showing the sidewall opening in the expanded mode having a width greater than the diameter of the awning roll when the awning roll is received within the tubular section.
Figure 4:
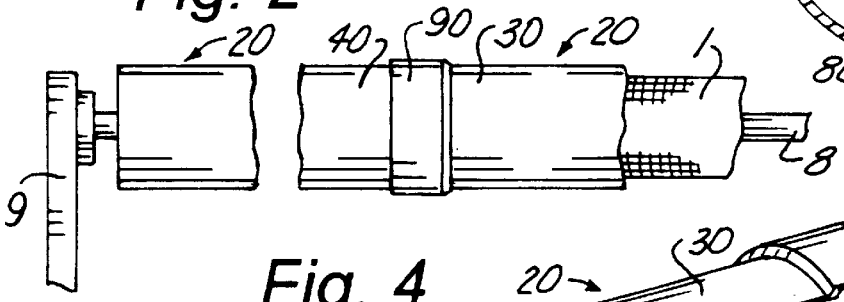
FIG. 4 is a partial front elevational view of the removable awning cover.

As can be seen by reference to the drawings, and in particularly to FIG. 1, the removable awning cover that forms the basis of the present invention is designated generally by the reference number 10. The awning cover 10 includes a plurality of resilient tubular sections 20 that are placed in overlapping adjacent relationship over an awning roll 1. The awning roll 1 is formed when a fabric awning attached to a structure, such as a recreational vehicle 3 is retracted into a roll adjacent the mounting rail 5. The mounting rail 5, as depicted in FIG. 3, may form a portion of a rain gutter 7 to which the top edge of the awning is attached. The bottom edge of the awning is attached to a spool 8 supported by arms 9 which lower the awning to its extended position (not shown).

Figure 2:
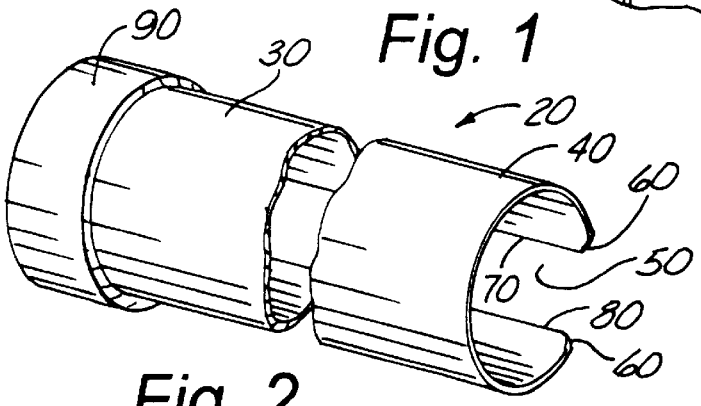
FIG. 2 is a foreshortened perspective view of one of the tubular sections that form the removable awning cover showing the sidewall opening in the relaxed mode having a width less than the diameter of the awning roll.
Figure 5:
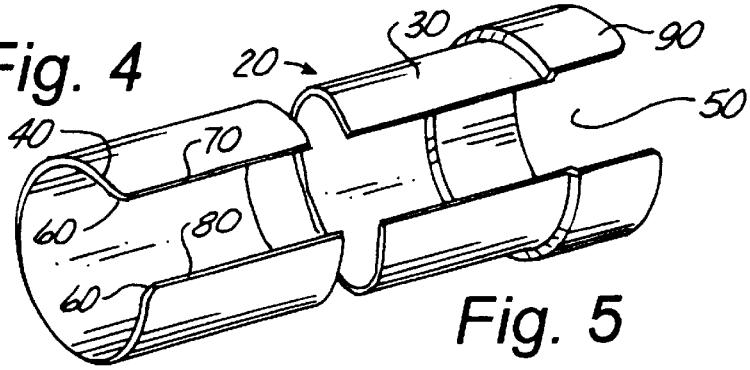
FIG. 5 is a foreshortened perspective view similar to FIG. 2, but showing the side of the tubular section having the sidewall opening.

Each of the tubular sections 20 has a first end 30, a second end 40 and an axially directed sidewall opening 50 with rounded covers 60. The sidewall opening 50 is movable between a relaxed width less than the diameter of the awning roll (FIGS. 2 and 5) where the awning roll 1 is held within the tubular section 20, and an expanded width greater than the diameter of the awning roll 1 (FIG. 3) where the awning roll 1 is received through the sidewall opening 50. The top edge 70 of the sidewall opening 50 rests on the mounting rail 5, and the bottom edge 80 is disposed below the awning roll 1 so that moisture will drip off away from the awning roll 1. The first end 30 of each tubular section 20 has a flared portion 90 that is disposed to overlie the second end 40 of the next adjacent tubular member 20.

The removable awning cover 10 is designed to protect and extend the life of the fabric of awnings, such as the type commonly installed on recreational vehicles or installed over a patio of a home. The removable awning cover 10 is designed of tubular sectional construction that can be fitted to any length and diameter of such awnings.

To install, each tubular section 20 is placed over the awning roll 1 with the top edge 70 of the first tubular section 20 placed into the rain gutter 7 or mounting rail 5 immediately and completely behind awning roll 1. This provides ventilation above awning roll 1. Remaining sections 20 that are designed with a flared end 90 to provide a portion for overlapping the adjacent section are then installed leaving the remaining portion of flared end 90 to provide ventilation around awning roll 1. When all the sections are installed, one unit is created that extends past the awning fabric roll 1 to prevent rain and snow from being pulled in between the layers of rolled up fabric.

There are many qualities this awning cover 10 possesses over and above all other hoods or awning covers currently on the market, such as being removable to allow the full beauty of the awning to be seen when the awning is in use. The circular design covers the roll 1 starting at the rain gutter 7 or mounting rail 5, over the top of the awning roll 1, down the front of the awning roll 1 and continues slightly past the bottom of the awning roll 1, directing water to the gutter 7 and over the roll 1 to drip off the bottom of awning cover 10. There are other known awning covers and hoods currently available, all of which are inextirpable, preventing access to the awning for maintenance or cleaning, and in some cases, creating potential problems of leakage and depreciation due to added holes for mounting. With these factors, many recreational vehicle owners and awning users find them unattractive. The present invention addresses and solves these problems.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A removable awning cover in combination with a fabric awning attached to a structure by a mounting rail and retracted into an awning roll having a predetermined diameter, the awning cover comprising:

a plurality of overlapping resilient adjacent tubular sections, each section having a first end, a second end, and an axially directed sidewall opening having a top edge, a bottom edge, and being movable between a relaxed width and an expanded width, the relaxed width being less than the diameter of the awning roll and the expanded width being greater than the diameter of the awning roll;

wherein a section of the awning roll is received through the sidewall opening of each adjacent tubular section when moved to the expanded width, and held within the tubular section when the sidewall opening is moved to the relaxed width; and wherein the top edge of the sidewall opening of each adjacent tubular section rests on a section of the mounting rail, and the bottom edge of the sidewall opening is disposed below a section of the awning roll.

2. The awning cover of claim 1 wherein each adjacent tubular section includes a sidewall opening with rounded corners.

3. The awning cover of claim 1 wherein the mounting rail forms a portion of a rain gutter.

4. The awning cover of claim 2 wherein the mounting rail forms a portion of a rain gutter.

5. The awning cover of claim 1 wherein the first end of each tubular section is flared and disposed to overlie the second end of the next adjacent tubular member.

6. The awning cover of claim 2 wherein the first end of each tubular section is flared and disposed to overlie the second end of the next adjacent tubular member.

7. The awning cover of claim 3 wherein the first end of each tubular section is flared and disposed to overlie the second end of the next adjacent tubular member.

8. The awning cover of claim 4 wherein the first end of each tubular section is flared and disposed to overlie the second end of the next adjacent tubular member.

* * * * *